US005750489A

United States Patent [19]

Garcia et al.

[11] Patent Number: 5,750,489

[45] Date of Patent: May 12, 1998

[54] LIQUID DETERGENT COMPOSTIONS CONTAINING STRUCTURING POLYMERS FOR ENHANCED SUSPENDING POWER AND GOOD POURABILITY

[75] Inventors: Rigoberto Felipe Garcia, Nutley; Tirucherai Varahan Vasudevan, West Orange; Albert Joseph Post, Teaneck; Feng-Lung Gordon Hsu, Tenafly, all of N.J.

[73] Assignee: Lever Brothers Company, Division of Conopco, Inc., New York, N.Y.

[21] Appl. No.: 591,247

[22] Filed: Jan. 18, 1996

Related U.S. Application Data

[63] Continuation-in-part of Ser. No. 402,675, Mar. 15, 1995, abandoned, which is a continuation-in-part of Ser. No. 242,224, May 13, 1994, abandoned.

[51] Int. Cl.[6] ..... C11D 17/00; C11D 3/37

[52] U.S. Cl. ..... 510/417; 510/303; 510/310; 510/318; 510/337; 510/339; 510/361; 510/418; 510/420; 510/434; 510/470; 510/475; 510/476

[58] Field of Search ..... 510/417, 475, 510/476, 434, 318, 361, 337, 303, 310, 339, 420, 418, 470

[56] References Cited

U.S. PATENT DOCUMENTS

| | | | |
|---|---|---|---|
| 4,648,987 | 3/1987 | Smith et al. . | |
| 4,857,226 | 8/1989 | Drapier et al. . | |
| 4,992,194 | 2/1991 | Liberati et al. . | |
| 5,006,273 | 4/1991 | Machin et al. . | |
| 5,073,285 | 12/1991 | Liberati et al. . | |
| 5,108,644 | 4/1992 | Machin et al. . | |
| 5,135,675 | 8/1992 | Elliiott et al. . | |
| 5,147,576 | 9/1992 | Montague et al. . | |
| 5,160,655 | 11/1992 | Donker et al. | 252/95 |
| 5,205,957 | 4/1993 | Van de Pas . | |
| 5,264,142 | 11/1993 | Hessel et al. . | |
| 5,281,355 | 1/1994 | Tsaur et al. . | |
| 5,281,356 | 1/1994 | Tsaur et al. . | |
| 5,437,810 | 8/1995 | Ewbank et al. . | |
| 5,489,397 | 2/1996 | Bainbridge | 254/174.24 |
| 5,494,602 | 2/1996 | Thomaides et al. | 252/174.17 |
| 5,534,183 | 7/1996 | Gopalkrishnan et al. | 510/434 |
| 5,536,440 | 7/1996 | Gopalkrishnan et al. | 510/417 |
| 5,597,508 | 1/1997 | Schepers et al. | 510/417 |

FOREIGN PATENT DOCUMENTS

| | | |
|---|---|---|
| 0471410 | 2/1992 | European Pat. Off. . |
| 91/05845 | 2/1991 | WIPO . |
| 91/08280 | 6/1991 | WIPO . |

*Primary Examiner*—Ardith Hertzog
*Attorney, Agent, or Firm*—Ronald A. Koatz

[57] ABSTRACT

The present invention relates to liquid detergent compositions comprising substantially linear, water soluble, highly salt-tolerant non-adsorbing, ionic polymers of MW 10,000 to 1,000,000 Daltons which, when added in defined minimum levels to structured heavy duty liquids, make the liquids highly shear thinning without decreasing pour viscosity of the composition or increasing it to a point where it is too thick. The compositions are also stable.

18 Claims, No Drawings

LIQUID DETERGENT COMPOSTIONS CONTAINING STRUCTURING POLYMERS FOR ENHANCED SUSPENDING POWER AND GOOD POURABILITY

RELATED APPLICATIONS

The present application is a continuation-in-part application of U.S. Ser. No. 08/402,675, filed Mar. 15, 1995 now abandoned, which in turn is a continuation-in-part application of U.S. Ser. No. 08/242,224, filed May 13, 1994, now abandoned.

BACKGROUND OF THE INVENTION

1. Field of the Invention

The present invention relates to aqueous liquid detergent compositions (heavy duty liquids or HDLs) which contain sufficient detergent active material and, optionally, sufficient dissolved electrolyte to result in a structure of lamellar droplets dispersed in a continuous aqueous phase. In particular, the invention is concerned with the formation of such compositions which are able to suspend relatively large particles without simultaneously causing a large increase in the pour viscosity of the liquids. Such compositions are formed by adding water soluble, highly salt tolerant, substantially linear, ionic, non-adsorbing polymers to an HDL that enhance the shear thinning behavior of the HDLs.

2. Background

The use of water soluble polymers (e.g., polyacrylates) to modify the rheological properties of heavy duty liquids (HDLs) is known.

In each of U.S. Pat. No. 5,006,273 to Machin et al., U.S. Pat. No. 5,108,644 to Machin et al. and U.S. Pat. No. 5,205,957 to Van de Pas et al., for example, viscosity reducing, water soluble polymers such as dextran, dextran sulfonate, polyacrylate, polymethacrylate, acrylatemaleate copolymer and polyethylene glycol and salts thereof are added to detergent compositions to lower the pour viscosity. In U.S. Pat. No. 5,006,273, the polymer claimed is from a group consisting of dextran sulfonate (up to 200,000 to 275,000 Daltons molecular weight), dextran (up to 20,000 Daltons), polyacrylate (up to 5,000 Daltons), acrylate maleate copolymer (up to 70,000 Daltons) and polyethylene glycol (up to 10,000 Daltons). In U.S. Pat. No. 5,205,957, the claimed molecular weight of the functional polymer is less than 2000.

The present invention differs from the cited references in a number of significant ways.

First and foremost, the polymers used in the present invention, which we refer to as structuring polymers, are viscosity enhancing polymers while similar polymers used in the cited art reduce viscosity.

Second, the molecular weight of the viscosity reducing polymer in the art is not critical and, in the case of polyacrylate, was 5,000 or 6000 Daltons. In the present invention, it is critical that the molecular weight of the structuring polymer be at least 10,000 Daltons. While not wishing to be bound by theory, it is believed the higher molecular weight increases shear thinning without decreasing the high shear viscosity which thereby renders the formulation more suitable for suspending large particles. Here, high shear viscosity means viscosity measured at or above a shear rate of 21 $sec^{-1}$. The viscosity measured at 21 $sec^{-1}$ is, henceforth, denoted as the pour viscosity.

Third, while no ceiling level is given for level of surfactant in these references, no example is given with greater than 25% surfactant level. Levels could not be raised higher in the art because the lack of deflocculating polymer (such as the type discussed in U.S. Pat. No. 5,147,576 to Montague et al.) would cause the lamellar droplets to flocculate. By contrast, surfactant used in the compositions of the subject invention are used in an amount greater than 30% by weight and have been used at levels as high as 45% and in theory could go much higher.

In short, in the references discussed above, lack of deflocculating polymer and the presence of viscosity reducing polymers are believed to have led to flocculation of the lamellar droplets at higher surfactant levels.

Montague et al., U.S. Pat. No. 5,147,576, also teaches the use of water soluble polymer that improves stability of heavy duty liquids at the same pour viscosity or lower pour viscosity without affecting stability. Again, our application differs because the molecular weight of the structuring polymer is critical: the structuring polymer enhances pour viscosity and shear thinning behavior when the structuring polymer molecular weight exceeds a specified value. In addition, critical minimal levels are required. These criticalities are neither taught nor suggested in Montague et al. In addition, in the only formulation taught by Montague et al. where acrylates like those of the invention are used (see Table 1 at column 24), the formulation also includes sodium oleate as a major component. By contrast, applicants have unexpectedly found that the structuring polymer satisfying our specified molecular weight requirements enhances the pour viscosity of heavy duty liquids that do not contain sodium oleate as a major component. All unsaturated fatty acids such as sodium oleate above a modest level, approximately 2%, are excluded from our formulations primarily because they impart a disagreeable odor. Unsaturated fatty acids also act as a defoaming agent, which is undesirable in our case.

U.S. Pat. No. 4,992,194, assigned to Liberati et al., also teaches the use of water soluble polymers of the type disclosed in Montague et al. for the same function, the decrease of pour viscosity of heavy duty liquids, but the specified liquids are characterized as pH jump formulations. A pH jump HDL, defined fully in Liberati et al., is one which contains components that will boost the pH of the wash liquor. Unexpectedly, we find that the structuring polymer enhances the pour viscosity above a critical surfactant concentration of approximately 30%, in contradiction to the teaching of Liberati et al. Furthermore, we also unexpectedly find that the structuring polymer of a specified molecular weight range enhances the shear thinning behavior of the liquid.

European Patent 471,410, assigned to Kaiserman and Siuta-Mangano, specifically teaches the use of polyacrylates as a compressing polymer in liquid detergent compositions up to a level of 0.5 percent by weight of the formulation. A compressing polymer performs the function of reducing the viscosity of the liquid detergent, as described in U.S. Pat. No. 5,147,576 by Montague et al. Our application of the use of structuring polymers, which may be polyacrylates, to enhance the viscosity of liquid detergent compositions differs from Kaiserman and Siuta-Mangano. We have noted that the structuring polymer must exceed a critical molecular weight, and this criticality was neither taught nor suggested by Kaiserman and Siuta-Mangano. In addition, the concentration of structuring polymer must exceed a threshold value in order to observe the viscosity enhancing effects. Again, this criticality was neither taught nor suggested by Kaiserman and Siuta-Mangano.

In no art is it recognized that use of structuring polymers in compositions having a minimum surfactant level will enhance suspending power of that composition without decreasing pour viscosity or raising it too high.

SUMMARY OF THE INVENTION

The present invention relates to aqueous liquid detergent compositions having sufficient detergent surfactants (i.e., greater than 30% by weight) and sufficient electrolyte/salt (i.e., at least 1%) to result in a structure of lamellar droplets dispersed in a continuous phase. The composition further contains at least 0.1% by weight deflocculating polymer as described below.

Unexpectedly, it has been found that when a substantially linear, water soluble, highly salt tolerant, non-adsorbing, ionic polymer having a molecular weight of at least 10,000 Daltons, which we refer to as the structuring polymer, is added to such compositions in an amount from about a lower limit defined by the equation $a(MW)^{-b}$, wherein a is at least 770 and b is 0.75, to about 20% by weight of the formulation, it is possible to enhance the suspending power of the composition without either decreasing the pour viscosity of the composition (i.e., viscosity measured at 21 $sec^{-1}$) or increasing the pour viscosity above 5000 mPas while still maintaining stability.

More specifically, the invention is a liquid detergent composition comprising (a) greater than 30% by weight (i.e., 31% and greater), preferably greater than 30 to 80% by wt. of one or more surfactants predominantly present as lamellar drops dispersed in an aqueous medium containing 1% to 60%, preferably at least 7%, more preferably at least 15% electrolyte.

(b) 0.1% to 20% by weight preferably 0.1 to 15%, preferably 0.5% to 10%, more preferably 1.0% to 5.0% by weight deflocculating polymer; and (c) a substantially linear, water soluble, highly salt-tolerant, non-adsorbing, ionic polymer (also referred to as structuring polymer) having a molecular weight of at least 10,000 Daltons used in a minimum amount on a weight basis defined by the equation:

$$a(MW)^{b}$$

wherein constant "b" equals 0.75 and the variable "a" is at least 770, preferably 1200 to an upper range amount of 20% by weight;

wherein said composition is highly shear thinning;

wherein said structuring polymer does not decrease the pour viscosity of the detergent liquid relative to pour viscosity prior to addition; and wherein stability of said composition means no more than 5% phase separation by volume upon storage at 37° C. for 30 days.

Highly shear thinning is determined by the flow index n of the Sisko rheological model, given by H. Barnes, J. F. Hutton, K. Walters, An Introduction to Rheology, Elsevier, 1989 as follows:

$$\eta+\eta_{\infty}+k\gamma^{n-1}$$

wherein $\eta$ and $\eta\infty$ are viscosity at a given shear rate and infinite shear viscosity, respectively, k and n are Sisko model constants and $\gamma$ is the shear rate.

Using this equation, n should be less than 0.35, more preferably less than 0.3.

Other terms are defined as follows:

Highly salt tolerant means that the polymer is soluble in a solution containing 20% citrate or any other salt at a level to match the ionic strength of a 20% citrate solution;

substantially linear means that the contribution to the molecular weight from the branched portion of the molecule is no more than 20%; and non-adsorbing refers to the lack of physical or chemical adsorption to the lamellar droplets.

DETAILED DESCRIPTION OF THE INVENTION

The present invention relates to aqueous liquid detergent compositions which contain a sufficient amount of detergent surfactant (greater than 30% by wt.) and sufficient dissolved electrolyte (at least 1% by weight) to result in a structure of lamellar droplets dispersed in a continuous aqueous phase.

The compositions of the invention are stable lamellar dispersions comprising: greater than 30% surfactant (i.e., from 31% to 80%) by weight; greater than 1% electrolyte; 0.1% to 20% by weight deflocculating polymer; and a lower limit defined by the equation of $a(MW)^{-b}$(as defined previously) to 20% by weight of a structuring; wherein, said composition is highly shear thinning. Stable lamellar dispersions have no more than 5% phase separation by volume upon storage at 37° C. for 30 days. In addition these compositions are substantially free of unsaturated fatty acids such as sodium oleate (i.e., no more than about 2%, preferably no more than 1%) and these may be absent.

Lamellar Dispersions

Lamellar droplets are a particular class of surfactant structures which, inter alia, are already known from a variety of references, e.g. H. A. Barnes, 'Detergents', Ch. 2. in K. Walters (Ed), 'Rheometry: Industrial Applications', J. Wiley & Sons, Letchworth 1980.

Such lamellar dispersions are used to endow properties such as consumer-preferred flow behavior and/or turbid appearance. Many are also capable of suspending particulate solids such as detergency builders or abrasive particles. Examples of such structured liquids without suspended solids are given in U.S. Pat. No. 4,244,840, whilst examples where solid particles are suspended are disclosed in specifications EP-A-160,342; EP-A-38,101; EP-A-104,452 and also in the aforementioned U.S. Pat. No. 4,244,840. Others are disclosed in European Patent Specification EP-A-151,884, where the lamellar droplet are called 'spherulites'.

The presence of lamellar droplets in a liquid detergent product may be detected by means known to those skilled in the art, for example optical techniques, various rheometrical measurements, X-ray or neutron diffraction, and electron microscopy.

The droplets consists of an onion-like configuration of concentric bi-layers of surfactant molecules, between which is trapped water or electrolyte solution (aqueous phase). Systems in which such droplets are close-packed provide a very desirable combination of physical stability and solid-suspending properties with useful flow properties.

In such liquids, there is a constant balance sought between stability of the liquid (generally, higher volume fraction of the dispersed lamellar phase, i.e., droplets, give better stability), the viscosity of the liquid (i.e., it should be viscous enough to be stable but not so viscous as to be unpourable) and solid-suspending capacity (i.e., volume fraction high enough to provide stability but not so high as to cause unpourable viscosity).

A complicating factor in the relationship between stability and viscosity on the one hand and, on the other, the volume fraction of the lamellar droplets is the degree of flocculation of the droplets. When flocculation occurs between the lamellar droplets at a given volume fraction, the viscosity of the corresponding product will increase owing to the formation of a network throughout the liquid. Flocculation may also lead to instability because deformation of the lamellar droplets, owing to flocculation, will make their packing more efficient. Consequently, more lamellar droplets will be required for stabilization by the space-filling mechanism, which will again lead to a further increase of the viscosity.

The volume fraction of droplets is increased by increasing the surfactant concentration and flocculation between the lamellar droplets occurs when a certain threshold value of the electrolyte concentration is crossed at a given level of surfactant (and fixed ratio between any different surfactant components). Thus, in practice, the effects referred to above mean that there is a limit to the amounts of surfactant and electrolyte which can be incorporated whilst still having an acceptable product. In principle, higher surfactant levels are required for increased detergency (cleaning performance). Increased electrolyte levels can also be used for better detergency, or are sometimes sought for secondary benefits such as building.

In U.S. Pat. No. 5,147,576 to Montague et al. it was found that addition of a deflocculating polymer allowed incorporation of more surfactant and/or electrolyte without compromising stability or making the compositions unpourable. The deflocculating polymer is as defined in Montague et al. incorporated by reference into the subject application. The level of deflocculating polymer in the present invention is 0.1% to 20% by weight, preferably 0.5% to 5% by weight, most preferably 1% to 3% by weight.

The compositions of Montague et al., however, even with deflocculating polymer, have poor solids suspending ability. This is evidenced by applicants visual observation of instability when particles in the size range of 500 to 750 microns, with a density that differed from the liquid density by 0.2 to 0.3 specific gravity units, were placed in such liquids.

In addition, in the only composition of Montague where a polyacrylate-maleate like that of the invention is used, there is also found relatively large amounts of unsaturated fatty acids such as oleate. These not only impart a bad aroma, but also act as undesirable defoaming agents. Such unsaturated acids are used in the present invention in amounts no greater than about 2% by wt., preferably no more than 1% by wt. and may be absent altogether.

pH-Jump HDL

A sub-class of lamellar dispersions included in the liquid detergent compositions, or HDLs, relevant to this invention are pH-jump HDLs. A pH-jump HDL is a liquid detergent composition containing a system of components designed to adjust the pH of the wash liquor. It is well known that organic peroxyacid bleaches are most stable at low pH (3–6), whereas they are most effective as bleaches in moderately alkaline pH (7–9) solution. Peroxyacids such as DPDA cannot be feasibly incorporated into a conventional alkaline heavy duty liquid because of chemical instability. To achieve the required pH regimes, a pH jump system has been employed in this invention to keep the pH of the product low for peracid stability yet allow it to become moderately high in the wash for bleaching and detergency efficacy. One such system is borax $10H_2O$/ polyol. Borate ion and certain cis 1,2 polyols complex when concentrated to cause a reduction in pH. Upon dilution, the complex dissociates, liberating free borate to raise the pH. Examples of polyols which exhibit this complexing mechanism with borax include catechol, galactitol, fructose, sorbitol and pinacol. For economic reasons, sorbitol is the preferred polyol.

Sorbitol or equivalent component (i.e., 1,2 polyols noted above) is used in the pH jump formulation in an amount from about 1 to 25% by wt., preferably 3 to 15% by wt. of the composition.

Borate or boron compound is used in the pH jump composition in an amount from about 0.5 to 10.0% by weight of the composition, preferably 1 to 5% by weight.

Bleach component is used in the pH jump composition in an amount from about 0.5 to 10.0% by weight of the composition, preferably 1 to 5% by weight.

Structuring Polymer

The structuring polymer of the invention is a substantially linear, water soluble, highly salt tolerant, non-absorbing, ionic compound with a molecular weight of at least 10,000 Daltons to 1 million Daltons, preferably 12,000 Daltons to 500,000 Daltons.

By highly salt tolerant it is meant that the polymer is soluble in solution containing 20% citrate or any other salt at a level that matches the ionic strength of a 20% citrate solution.

By substantially linear it is meant that the contribution to the molecular weight from the branched portion of the molecule is no more than 20%.

By non-absorbing it is meant that there is no physical or chemical adsorption to the lamellar drops.

The structuring polymers are selected from the following anionic polymers: polyacrylic acids, copolymers of acrylic and maleic acids, polystyrene sulfonic acids, and the salts thereof, poly 2-hydroxy ethyl acrylate, dextran sulfate, dextran sulfonate, poly 2-sulfato ethyl methacrylate, polyacryloamido methyl propane sulfonate, and the acid forms thereof. Particularly preferred are polyacrylic acids, copolymers of acrylic and maleic acids, polystyrene sulfonic acids and salts thereof, and dextran sulfate.

Unexpectedly, applicants have discovered that the addition of substantially linear, water soluble, highly salt tolerant, non-adsorbing, ionic polymer (as defined above) of molecular weight at least 10,000 Daltons (i.e., referred to as structuring polymers) to the compositions described above allows much larger particles to be suspended than previously possible. Suspension properties are achieved by making the composition highly shear thinning without decreasing the pour viscosity (i.e., it does not become thinner), without increasing the pour viscosity above 5000 mPas and naturally, without sacrificing stability.

Highly shear thinning can be quantified by the flow index of the Sisko rheological model, which is given by H. Barnes, J. F. Hutton, K. Walters, An Introduction to Rheology, Elsevier, 1989 as follows:

$$\eta=\eta_{2s}+k\gamma^{n-1}$$

Using the equation, n should be less than 0.35, more preferably less than 0.3.

While not wishing to be bound by theory, these unexpected properties are believed to be caused because the solvated volume of the structuring polymer effectively adds to the dispersed phase volume, thereby increasing the volume fraction and increasing the viscosity, and it is also believed that the structuring polymer forms a network through the continuous phase in quiescent fluid, which is more easily disrupted at higher shear rates, thereby causing the fluid to be more shear thinning. By contrast, it is believed that lower molecular weight polymers compress the lamellar drops in the dispersed phase thereby reducing volume fraction and viscosity.

The level of structuring polymer in the present invention is greater than a value defined by the equation:

$$a(MW)^b$$

to 20% by weight of the entire formulation, where the constant b equals 0.75 and the variable a is at least 770, preferably at least 1200. Preferably, the level varies from 0.5% to 5.0% by wt., more preferably 0.5% to 3.0% by weigh of the composition. In general, the lower limit will vary to some extent on what the molecular weight of the structuring polymer is and, generally, the higher the molecular weight, the smaller the actual cited concentration needed. Specific examples are as set forth below:

TABLE 1

Threshold Structuring Polymer Concentration*

| Molecular Weight | Concentration |
|---|---|
| 12,500 | 0.65 |
| 60,000 | 0.20 |
| 190,000 | 0.085 |

*Level in weight % of the entire formulation that the structuring polymer must exceed for the detergent liquid to exhibit shear thinning. Concentrations are calculated from the equation $a(MW)^{-b}$ where a = 770 and b = 0.75.

The average molecular weight of the structuring polymer is defined to be greater than 10,000 Daltons and less than one million Daltons, preferably greater than 12,000 Daltons and less than 500,000 Daltons.

Electrolytes

As used herein, the term electrolyte means any ionic water-soluble material. However, in lamellar dispersions, not all the electrolyte is necessarily dissolved but may be suspended as particles of solid because the total electrolyte concentration of the liquid is higher than the solubility limit of the electrolyte. Mixtures of electrolytes also may be used, with one or more of the electrolytes being in the dissolved aqueous phase and one or more being substantially only in the suspended solid phase. Two or more electrolytes may also be distributed approximately proportionally, between these two phases. In part, this may depend on processing, e.g. the order of addition of components. On the other hand, the term 'salts' includes all organic and inorganic materials which may be included, other than surfactants and water, whether or not they are ionic, and this term encompasses the sub-set of the electrolytes (water-soluble materials).

The compositions contain electrolyte in an amount sufficient to bring about structuring of the detergent surfactant material. Preferably though, the compositions contain from 1% to 60%, more preferably from 7 to 45%, most preferably from 15% to 30% of a salting-out electrolyte. Salting-out electrolyte has the meaning ascribed to in specification EP-A-79646. Optionally, some salting-in electrolyte (as defined in the latter specification) may also be included, provided if of a kind and in an amount compatible with the other components and the compositions is still in accordance with the definition of the invention claimed herein.

A very wide variation in surfactant types and levels is possible. The selection of surfactant types and their proportions, in order to obtain a stable liquid with the required structure will be fully within the capability of those skilled in the art. However, it can be mentioned that an important sub-class of useful compositions is those where the detergent surfactant material comprises blends of different surfactant types. Typical blends useful for fabric washing compositions include those where the primary surfactant(s) comprise nonionic and/or a non-alkoxylated anionic and/or an alkoxylated anionic surfactant.

The total detergent surfactant material in the present invention is present at from greater than 30% to about 80% by weight of the total composition, preferably from greater than 30% to 50% by weight.

In the case of blends of surfactants, the precise proportions of each component which will result in such stability and viscosity will depend on the type(s) and amount(s) of the electrolytes, as is the case with conventional structured liquids.

In the widest definition the detergent surfactant material in general, may comprise one or more surfactants, and may be selected from anionic, cationic, nonionic, zwitterionic and amphoteric species, and (provided mutually compatible) mixtures thereof. For example, they may be chosen from any of the classes, sub-classes and specific materials described in 'Surface Active Agents' Vol. I, by Schwartz & Perry, Interscience 1949 and 'Surface Active Agents' Vol. II by Schwartz, Perry & Berch (Interscience 1958), in the current edition of "McCutcheon's Emulsifiers & Detergents" published by the McCutcheon division of Manufacturing Confectioners Company or in 'Tensid-Taschenbuch', H. Stache, 2nd Edn., Carl Hanser Verlag, Munchen & Wien, 1981.

Suitable nonionic surfactants include, in particular, the reaction products of compounds having a hydrophobic group and a reactive hydrogen atom, for example aliphatic alcohols, acids, amides or alkyl phenols with alkylene oxides, especially ethylene oxide, either alone or with propylene oxide. Specific nonionic detergent compounds are alkyl ($C_6$–$C_{18}$) primary or secondary, linear or branched alcohols with ethylene oxide, and products made by condensation of ethylene oxide with the reaction products of propylene oxide and ethylenediamine. Other so-called nonionic detergent compounds include long chain tertiary amine oxides, long-chain tertiary phosphine oxides and dialkyl sulphoxides.

Other suitable nonionics which may be used include aldobionamides such as are taught in U.S. Pat. No. 5,389,279 to Au et al. and polyhydroxyamides such as are taught in U.S. Pat. No. 5,312,954 to Letton et al. Both of these references are hereby incorporated by reference into the subject application.

Suitable anionic surfactants are usually water-soluble alkali metal salts of organic sulphates and sulphonates having alkyl radicals containing from about 8 to about 22 carbon atoms, the term alkyl being used to include the alkyl portion of higher acyl radicals. Examples of suitable synthetic anionic detergent compounds are sodium and potassium alkyl sulphates, especially those obtained by sulphating higher ($C_8$–$C_{18}$) alcohols produced, for example, from tallow or coconut oil, sodium and potassium alkyl ($C_9$–$C_{20}$) benzene sulphonates, particularly sodium linear secondary alkyl ($C_{10}$–$C_{15}$) benzene sulphonates; sodium alkyl glyceryl ether sulphates, especially those ethers of the higher alcohols derived from tallow or coconut oil and synthetic alcohols derived from petroleum; sodium coconut oil fatty monoglyceride sulphates and sulphonates; sodium and potassium salts of sulfuric acid esters of higher ($C_8$–$C_{18}$) fatty alcohol-alkylene oxide, particularly ethylene oxide, reaction products; the reaction products of fatty acids such as coconut fatty acids esterified with isethionic acid and neutralized with sodium hydroxide; sodium and potassium salts of fatty acid amides of methyl taurine; alkane monosulphonates such as those derived by reacting alpha-olefins ($C_8$–$C_{20}$) with sodium bisulphite and those derived from reacting paraffins with $SO_2$ and $CI_2$ and then hydrolyzing with a base to produce a random sulphonate; and olefin sulphonates, which term is used to describe the material made by reacting olefins, particularly $C_{10}$–$C_{20}$ alpha-olefins, with $SO_3$ and then neutralizing and hydrolyzing the reaction product. The preferred anionic detergent compounds are sodium ($C_{11}$–$C_{15}$) alkyl benzene sulphonates and sodium ($C_{10}$–$C_{18}$) alkyl sulphates.

It is also possible to include an alkali metal soap of a long chain mono- or dicarboxylic acid for example one having 12 to 18 carbon atoms at low levels, for example less than 2% by weight of the composition. Higher levels of unsaturated fatty acid soaps, such as oleic acid and salts thereof, for example, would impart an undesirable odor and reduce the foam level of the composition. A preferred group of anionic surfactants can be those from the group consisiting of alcohol ethoxylates, alkyl sulfates, alkyl ether sulfates, alkyl ether sulfonates, alkyl benzene sulphonates, acyl isethionates saturated fatty acids, alkyl polyglycosides and aldobionamides.

Other Ingredients

Preferably the amount of water in the composition is from 5 to 69%, more preferred from 20 to 65%, most preferred from 25 to 50%. Especially preferred less than 45% by weight.

Some or all of the electrolyte (whether salting-in or salting-out), or any substantially water-insoluble salt which may be present, may have detergency builder properties. In any event, it is preferred that compositions according to the present invention include detergency builder material, some or all of which may be electrolyte. The builder material is any capable of reducing the level of free calcium ions in the wash liquor and will preferably provide the composition with other beneficial properties such as the generation of an alkaline pH, the suspension of soil removed from the fabric and the dispersion of the fabric softening clay material.

Examples of phosphorous-containing inorganic detergency builders, when present, include the water-soluble salts, especially alkali metal pyrophosphates, orthophosphates, polyphosphates and phosphonates. Specific examples of inorganic phosphate builders include sodium and potassium tripolyphosphates, phosphates and hexametaphosphates. Phosphonate sequestrant builders may also be used.

Examples of non-phosphorus-containing inorganic detergency builders, when present, include water-soluble alkali metal carbonates, bicarbonates, silicates and crystalline and amorphous aluminosilicates. Specific examples include sodium carbonate (with or without calcite seeds), potassium carbonate, sodium and potassium bicarbonates, silicates and zeolites.

In the context of inorganic builders, we prefer to include electrolytes which promote the solubility of other electrolytes, for example use of potassium salts to promote the solubility of sodium salts. Thereby, the amount of dissolved electrolyte can be increased considerably (crystal dissolution) as described in UK patent specification GB 1,302,543.

Examples of organic detergency builders, when present, include the alkaline metal, ammonium and substituted ammonium polyacetates, carboxylates, polycarboxylates, polyacetyl carboxylates, carboxymethyl oxysuccinates, carboxymethyloxymalonates, ethylene diamine-N,N, disuccinic acid salts, polyepoxysuccinates, oxydiacetates, triethylene tetramine hexacetic acid salts, N-alkyl imino diacetates or dipropionates, alpha sulpho-fatty acid salts, dipicolinic acid salts, oxidized polysaccharides, polyhydroxysulphonates and mixtures thereof.

Specific examples include sodium, potassium, lithium, ammonium and substituted ammonium salts of ethylenediaminetetraacetic acid, nitrilotriacetic acid, oxydisuccinic acid, melitic acid, benzene polycarboxylic acids and citric acid, tartrate mono succinate and tartrate di-succinate.

The deflocculating polymer is as defined in U.S. Pat. No. 5,147,576 to Montague et al. incorporated by reference into the subject application.

Although it is possible to incorporate minor amounts of hydrotropes such as lower alcohols (e.g., ethanol) or alkanolamines (e.g., triethanolamine), in order to ensure integrity of the lamellar dispersion we prefer that the compositions of the present invention are substantially free from hydrotropes. By hydrotrope is meant any water soluble agent which tends to enhance the solubility of surfactants in aqueous solution.

Apart from the ingredients already mentioned, a number of optional ingredients may also be present, for example lather boosters such as alkanolamides, particularly the monoethanolamides derived from palm kernel fatty acids and coconut fatty acids, fabric softeners such as clays, amines and amine oxides, lather depressants, oxygen-releasing bleaching agents such as sodium perborate and sodium percarbonate, peracid bleach precursors, chlorine-releasing bleaching agents such as trichloroisocyanuric acid, inorganic salts such as sodium sulphate, and usually present in very minor amounts, fluorescent agents, perfumes, enzymes such as proteases, amylases and lipases (including Lipolase (Trade Mark) ex Novo), germicides and colorants.

EXAMPLES

The invention will now be illustrated by way of the following Examples. In all Examples, unless stated to the contrary, all percentages are by weight.

Materials

Surfactants: Linear alkylbenzenesulfonic acid (LAS acid) and Neodol 25-9 (alcohol ethoxylate; $C_{12-15}EO_9$) were of commercial grade and were supplied by Vista Chemicals and Shell Chemicals respectively.

Polymers: Low molecular weight (MW) polyacrylic acids, NSC 91B (MW 2800 Daltons), were supplied by National Starch and Chemicals. NSC #7706:2 (60,000 MW) was also supplied by National Starch. Sokalan PA50 (polyacrylic acid of MW=12,500) was obtained from BASF Chemicals. Acumer 1530 (MW 190,000 Daltons) was obtained from Rohm and Haas. Deflocculating polymer (Narlex DC1) was supplied by National Starch and Chemicals (The deflocculating polymer is an acrylic acid/lauryl methacrylic copolymer of M.W. of about 3800).

Dextran (MW 15–20K Daltons) and dextran sulfate (500,000 Daltons) was supplied by Polysciences Inc. Polystyrene sulfonate (MW 70K) was supplied by Aldrich. The acrylate maleate copolymers used were Sokalan CP-5 (MW 70K), Sokalan CP-7 (MW 50K), CP-9 (MW 12,000), CP13S (MW 20,000) and were supplied by BASF; and NSC 91D (MW 2,400) and NSC 91H (MW 8,000) were supplied by National Starch and Chemicals.

Inorganic Reagents: Sodium citrate dihydrate used was of analytical reagent grade and was purchased from Aldrich Chemicals. 50 weight percent sodium hydroxide of analytical reagent grade was supplied by Fisher Scientific Company.

Other Reagents: Deionized water was used in all the formulations and for reagent dilution.

Example 1 (Comparative)

The following compositions were prepared by adding Sorbitol, Borax, NaOH solution and $Na_2SO_4$, in that order, to deionized water. This was followed by addition of the deflocculating polymer (Narlex DC-1), and surfactant actives. This composition was continuously mixed and maintained at 55° C. during the additions. To this composition, Sokalan PA 50 solution or an amount of deionized water equal in wt. to the Sokalan PA 50 solution (i.e., to equilibrate the amount of surfactant) was added at room temperature.

| Base Formulation | | |
|---|---|---|
| Composition. | A | B |
| LAS - acid | 15.1 | 15.1 |
| Neodol 25-9 | 6.9 | 6.9 |
| NaOH 50% solution | 3.8 | 3.8 |
| Borax | 5.0 | 5.0 |
| Sorbitol | 20.0 | 20.0 |
| $Na_2SO_4$ | 2.5 | 2.5 |
| Narlex DC1 (33% solution) | 3.0 | 3.0 |
| Sokalan PA 50 (40% solution) | 0.0 | 5.0 |
| Water deionized | to 100.0 | to 100.0 |
| Rheological properties | | |
| Sisko Index | 0.36 | 0.5 |
| Pour Viscosity (mpa.s @ 21 $sec^{-1}$) | 952 | 311 |

Comparative 1A and 1B above are compositions substantially similar to Example 1 of Liberati et al, U.S. Pat. No. 4,992,194. Addition of Sokalan PA 50 can be seen to decrease the pour viscosity of the formulation as taught by Liberati et al. (see 1B). We also note that the Sisko index increases, i.e., the liquid becomes less shear thinning, which does not satisfy the objective of the present invention. We draw attention to this fact because the surfactant level in the above formulations falls below the critical surfactant concentration of 30% by weight, specified in the present invention.

This example clearly demonstrates the criticality unrecognized by Liberati based of surfactant levels.

Example 2

The following composition was prepared by adding citrate and NaOH to water, followed by deflocculating polymer Narlex (DC-1) and detergent surfactants. The composition was continuously stirred and maintained at 55° C. during the additions.

| Base Formulation: | |
|---|---|
| Composition. | Parts |
| LAS - acid | 31.0 |
| Neodol 25-9 | 13.2 |
| | Total surfactants 44.2 |
| 50% NaOH | 7.9 |
| Na-citrate 2.$H_2O$ (salt) | 16.4 |
| Deionized water | 28.4 |
| Narfex DC-1 (33% actives Solution)* | 3.1 |

*Defined as in Example 1

The following results were obtained.

| | Added Polyacrylate | | Narlex DC-1 | Sisko | Pour Viscosity | % BLS[1] 30 days @ |
|---|---|---|---|---|---|---|
| | MW[2] | wt. % | wt. % | Index | (mPa · s) | 37° C. |
| A | none[3] | — | 1.46 | 0.46 | 993 | 0 |
| B | 2.8K | 2.0 | 1.5 | 0.46 | 370 | 0 |
| C | 12.5K | 0.5 | 1.46 | 0.37 | 365 | 0 |
| D | 12.5K | 2.0 | 1.46 | 0.15 | 1350 | 0 |
| E | 12.5K | 2.0 | 1.95 | 0.14 | 1677 | 0 |
| F | 60K | 0.5 | 1.5 | 0.21 | 1439 | 0 |
| G | 60K | 0.5 | 1.98 | 0.17 | 1558 | 0 |

-continued

| | Added Polyacrylate | | Narlex DC-1 | Sisko | Pour Viscosity | % BLS[1] 30 days @ |
|---|---|---|---|---|---|---|
| | MW[2] | wt. % | wt. % | Index | (mPa · s) | 37° C. |
| H | 190K | 0.5 | 1.0 | 0.26 | 534 | 1.7 |
| I | 190K | 1.0 | 1.0 | 0.15 | 1357 | 1.6 |

[1]% BLS = % of total volume that separates to form a bottom clear layer.
[2]MW corresponding to the polyacrylate tradenames are: 2.8K, NSC 91B; 12.5K, Sokalan PA 50; 60K, NSC #7706:2; 190K, Rohm and Haas Acumer 1530.
[3]Where no polyacrylate is added, an amount of water equal in weight to the polymer solution was added to equilibrate the surfactant levels.

Example 2 demonstrates the critical nature of both the structuring polymer molecular weight and the structuring polymer concentration. When taken with Comparative Example 1, the example also demonstrates the critical nature of surfactant concentration in the formulation.

Formulation of Example 2B, which includes a 2,800 molecular weight polyacrylate, does not make the liquid more shear thinning in comparison to the base liquid, 2A, as quantified by their equal Sisko indices. Formulations of Example 2DI, with polyacrylates of molecular weight greater than 10,000 and with polyacrylate concentration greater than the minimum concentration defined in Table 1, exhibit considerable shear thinning (Sisko index less than 0.3) in comparison to the base. The formulation of Example 2C, by contrast, shows that the liquid does not exhibit considerable shear thinning when the threshold concentration, as defined by Table 1, is not exceeded. Thus, there is clearly a concentration criticality.

Comparative formulation 1B and formulations 2D and 2E all contain 12,500 molecular weight polyacrylate, Sokalan PA 50. Examples 2D and 2E show enhanced shear thinning behavior compared to their base, Example 2A, while Comparative 1 B actually shows reduced shear thinning compared to its base, Comparative 1A. The major distinction between the formulation of the Comparative and Example 2 is the surfactant level. The surfactant level is about 22% in the comparative, while it is about 44% in Example 2.

Example 3

The following composition was prepared following the method of Example 2.

| Base Formulation: | |
|---|---|
| Composition | Parts |
| LAS-Acid | 26.0 |
| Neodol 25-9 | 11.5 |
| | Total surfactants 37.5 |
| 50% NaOH | 6.5 |
| Na-citrate 2$H_2O$ (salt) | 16.3 |
| Deionized water | 33.2 |
| Narlex DC-1 (33% actives solution) | 3.0 |

Aqueous solutions of structuring polymer (polyacrylates of molecular weight 12.5K contained 40 weight percent active polymer while those of 60K contained 25 weight percent active polymer) and additional deflocculating polymer (Narlex DC-1; contains 33% active polymer), if necessary, were added on top of the base formulation.

The following results were obtained.

| Polyacrylate Added | MW (of polyacrylate) | Wt. % (of active) | DC-1 (wt. %) | Sisko Index | Pour Viscosity mPas $21s^{-1}$ | % BLS (v/v) 30 days @ 37° C. |
|---|---|---|---|---|---|---|
| None* | | — | 1.5 | 0.48 | 315 | 0.4 |
| | 60K | 0.5 | 1.5 | 0.20 | 577 | 1.4 |
| None | | — | 1.5 | 0.48 | 356 | 0.4 |
| | 60K | 1.5 | 1.5 | 0.14 | 1,704 | 1.1 |
| None | | — | 1.5 | 0.49 | 309 | 0.4 |
| | 60K | 2.0 | 1.5 | 0.09 | 2,282 | 0.0 |

*Where no polyacrylate was added, an amount of water equal in weight to the amount of polyacrylate solution was added.

This example demonstrates that shear thinning increases (as shown by decreasing Sisko index) with increasing polymer concentration.

Example 4

The following composition was prepared.

Structuring polymer (aqueous solution of 60K molecular weight polyacrylate containing 25 weight percent actives) was added prior to surfactants addition unlike in the previous two examples in which structuring polymer was added to the base formulation which contains surfactants.

| Composition | Parts |
|---|---|
| LAS-acid | 21.0–31.5 |
| Neodol 25-9 | 9.0–13.5 |
| | Total surfactants 30.0–45.0 |
| 50% NaOH | 5.3–8.0 |
| Na-citrate $2H_2O$ | 14.2–18.4 |
| PAA 60K (25 wt % solution)* | 0–8.0 |
| Nartex DC-1 (33 wt % solution) | 4.5 |
| Deionized water | up to 100 parts |

*Polyacrylic acid (NSC #7706.2)

These ratios were maintained constant in various formulations

LAS Acid/50% NaOH=3.9

LAS Acid/Neodol 25-9=2.33

Na-citrate. 2 $H_2O$/(0.056 LAS Acid+0.67 Narlex DC-1+0.75 PAA 60K+0.5 50% NaOH +DI water), all in parts =0.385

The following results were obtained.

| Surfactant level wt. % | PAA 60K wt. % (of active) | Sisko Index | Pour Viscosity mPas $21s^{-1}$ | % BLS (v/v) 30 days @ 37° C. |
|---|---|---|---|---|
| 30.0 | — | Viscosity not | measured | 0.0 |
| 30.0 | 1.0 | Viscosity not | measured | 28.0 |
| 37.5 | — | 0.44 | 290 | 0.0 |
| 37.5 | 0.5 | 0.23 | 526 | 2.8 |
| 37.5 | 1.0 | 0.21 | 1,439 | 1.5 |
| 37.5 | 1.5 | 0.14 | 1,946 | 1.1 |
| 37.5 | 2.0 | 0.14 | 3,889 | 0.0 |
| 45.0 | — | 0.48 | 787 | 0.0 |
| 45.0 | 1.0 | 0.05 | 4,719 | 0.0 |

This example shows that at surfactant levels at or below 30 weight percent, a stable formulation cannot be obtained in the presence at structuring polymers. Furthermore, this example shows that, irrespective of the point of addition of structuring polymer (i.e., whether added before or after surfactants addition), the desired shear thinning property can be achieved with this polymer. Example 5

The following composition was prepared as follows:

Structuring polymer (aqueous solution of 70K molecular weight polystyrenesulfonate containing 25 weight percent actives) was added prior to surfactants addition unlike in examples 1 and 3 in which structuring polymer was added to the base formulation which contains surfactants.

| Composition | Parts |
|---|---|
| LAS - Acid | 24.5–31.5 |
| Neodol 25-9 | 10.5–13.5 |
| | Total surfactants 35.0–45.0 |
| 50% NaOH | 6.0–8.0 |
| Na-citrate $2H_2O$ | 14.2–16.9 |
| PSS 70K (25 wt % solution)* | 0–8.0 |
| Narlex DC-1 (33 wt % solution) | 4.5 |
| Deionized water | up to 100 parts |

*Polystyrene sulfonate

These ratios were maintained constant in various formulations

BDA/50% NaOH=3.9

BDA/Neodol 25-9=2.33

Na-citrate. 2 $H_2O$/(0.056 LAS Acid+0.67 Narlex DC-1+0.75 PSS 70K+0.5 50% NaOH+DI water), all in parts=0.385

The following results were obtained.

| Surfactant level Parts | PSS 70K wt. % (of active) | Sisko Index | Pour Viscosity mPas $21S^{-1}$ | % BLS (v/v) 30 days @ 37° C. |
|---|---|---|---|---|
| 35.0 | — | 0.39 | 224 | 0.0 |
| 35.0 | 1.0 | 0.23 | 264 | 1.3 |
| 35.0 | 2.0 | 0.17 | 393 | 2.7 |
| 40.0 | — | 0.46 | 395 | 0.4 |
| 40.0 | 1.0 | 0.21 | 517 | 0.5 |
| 40.0 | 2.0 | 0.13 | 735 | 1.2 |
| 45.0 | — | 0.48 | 638 | 0.3 |
| 45.0 | 1.0 | 0.18 | 957 | 0.3 |
| 45.0 | 2.0 | 0.16 | 2,003 | 0.0 |

This example shows that different high molecular weight structuring polymers (e.g., PSS) will have the same effect of improving shear thinning (i.e., suspending power) without decreasing pour viscosity or raising it so high that the composition becomes unpourable.

Example 6

The following composition was prepared as follows:

Structuring polymer (aqueous solution of 70K or 500K molecular weight polystyrenesulfonate containing 25 weight percent actives) was added prior to surfactants addition unlike in examples 1 and 3 in which structuring polymer was added to the base formulation which contains surfactants.

| Composition | Parts |
|---|---|
| LAS - Acid | 24.5–31.5 |
| Neodol 25-9 | 10.5–13.5 |
| | Total surfactants 35.0–45.0 |
| 50% NaOH | 6.0–8.0 |
| Na-citrate $2.H_2O$ | 14.2–16.9 |
| PSS 70K or 500K (25 wt % solution) | 0 or 8.0 |
| Narlex DC-1 (33 wt % solution) | 4.5 |
| Deionized water | up to 100 parts |

These ratios were maintained constant in various formulations

BDA/50% NaOH=3.9

BDA/Neodol25-9=2.33

Na-citrate. 2 $H_2O$/(0.056 LAS Acid+0.67 Narlex DC-1+0.75 PSS 70K+0.5 50% NaOH+DI water), all in parts=0.385

The following results were obtained:

| PSS concn. wt. % | Mol. wt. Daltons | Sisko Index "n" | Pour Viscosity mPas @ $21s^{-1}$ | BLS % (V/V) 30 days @ 37° C. |
|---|---|---|---|---|
| None | — | 0.44 | 319 | 0.0 |
| 1.5 | 70,000 | 0.26 | 397 | 1.8 |
| 2.0 | 500,000 | 0.22 | 1287 | 1.41 |

This example shows that polystyrene sulfonate (PSS) of both 70,000 and 500,000 Daltons cause a steep decrease in Sisko Index without decreasing the pour viscosity or increasing it above 5,000 mPas.

Example 7

The following composition was prepared as follows:

Structuring polymer (aqueous solution of acrylate-maleate copolymer of different molecular weights) was added prior to surfactants addition as in examples 4 and 5.

| Component | Parts |
|---|---|
| LAS Acid | 26.0 |
| Neodol 25-9 | 11.5 |
| | Total surfactants 37.5 |
| 50% NaOH | 6.5 |
| Na-citrate $2.H_2O$ | 15.9–16.3 |
| Acrylate-Maleate copolymers (25 wt. % solution) | 0 or 8.0 |
| Narlex DC-1 (33 wt % solution) | 4.5 |
| Deionized water | up to 100 parts |

These ratios were maintained constant in various formulations

LAS Acid/50% NaOH=3.9

LAS Acid/Neodol 25-9=2.33

Na-citrate. $2H_2O$/(0.056 LAS acid+0.67 Narlex DC 1+0.75 CP-5+0.5 50% NaOH)=0.385

The following results were obtained:

| Polymer | Mol. wt. Daltons | Sisko Index "n" | Pour Viscosity mPas @ $21s^{-1}$ | BLS % (V/V) 30 days @ 37° C. |
|---|---|---|---|---|
| None | — | 0.44 | 290 | 0.0 |
| NSC 91D | 2,400 | 0.62 | 450 | 0.8 |

-continued

| Polymer | Mol. wt. Daltons | Sisko Index "n" | Pour Viscosity mPas @ $21s^{-1}$ | BLS % (V/V) 30 days @ 37° C. |
|---|---|---|---|---|
| NSC 91H | 8,000 | 0.5 | 300 | 0.64 |
| Sokalan CP 9 | 12,000 | 0.36 | 339 | 0.63 |
| Sokalan 13S | 20,000 | 0.23 | 1,283 | 0.0 |
| Sokalan CP 7 | 50,000 | 0.20 | 1,095 | 1.12 |
| Sokalan CP 5 | 70,000 | 0.19 | 905 | 0.6 |

This example shows that there is a criticality in acrylate-maleate copolymer molecular weight in terms of inducing increased shear thinning behavior. Below 8,000 Daltons it can be seen that the polymers, if at all, reduces the shear thinning character as seen by an increase in Sisko Index as opposed to polymers above 12,000 Daltons which reduce the Sisko Index.

Example 8

The following composition was prepared as follows:

Structuring polymer (aqueous solution of 70,000 Daltons acrylate-maleate copolymer, Sokalan CP5) was added prior to surfactants addition as in examples 4 and 5.

| Component | Parts |
|---|---|
| LAS Acid | 26.0 |
| Neodol 25-9 | 11.5 |
| Total surfactants | 37.5 |
| 50% NaOH | 6.5 |
| Na-citrate $2H_2O$ | 15.9–16.3 |
| Sokalan CP-5 (25 wt. solution) | 0–8.0 |
| Narlex DC-1 (33 wt % solution) | 4.5 |
| Deionized water | up to 100 parts |

These ratios were maintained constant in various formulations.

LAS acid/50% NaOH=3.9;

LAS acid/Neodol 25-9=2.33

Na citrate $2H_2O$/(0.056 LAS acid+0.67 Narlex DC-1+0.75 CP5+0.5 50% NaOH )=0.385

The following results were obtained:

| Sokalan CP-5 (wt. % of active) | Sisko Index | Pour Viscosity mPas 21 $s^{-1}$ | % BLS (v/v) 30 days @ 37° C. |
|---|---|---|---|
| 0.0 | 0.44 | 290 | 0.0 |
| 0.5 | 0.41 | 426 | 0.4 |
| 1.5 | 0.18 | 657 | 1.3 |
| 2.0 | 0.19 | 905 | 0.6 |

This example shows that increasing the polymer concentration results in reduction of Sisko Index (more shear thinning at higher polymer concentration).

Example 9

The following composition was prepared as follows:

Structuring polymer (aqueous solution of 500,000 Daltons Dextran Sulfate) was added prior to surfactants addition as in Examples 4 and 5.

| Composition | Parts |
|---|---|
| LAS - Acid | 26.0 |
| Neodol 25-9 | 11.5 |
| | Total surfactants 37.5 |
| 50% NaOH | 6.5 |
| Na-citrate $2.H_2O$ | 15.9–16.3 |
| Dexran Sulfate (25 wt % solution) | 0–8.0 |
| Narlex DC-1 (33 wt % solution) | 4.5 |
| Deionized water | up to 100 parts |

These ratios were maintained constant in various formulations

BDA/50% NaOH=3.9

BDA/Neodol 25-9=2.33

Na-citrate. 2 $H_2O$/(0.056 LAS Acid+0.67 Narlex DC-1+0.75 CP-5+0.5 50% NaOH=0.385

The following results were obtained.

| % Active | Sisko Index | Pour Viscosity mPas $21s^{-1}$ | % BLS (v/v) 30 days E 37° C. |
|---|---|---|---|
| 0.0 | 0.44 | — | 0.0 |
| 0.5 | 0.34 | 463 | 0.45 |
| 1.0 | 0.22 | 668 | 1.18 |
| 1.5 | 0.19 | 1,017 | 0.76 |
| 2.0 | 0.17 | 1,478 | 0.73 |

This example again shows that increasing the polymer concentration results in reduction of Sisko Index.

Example 10

A pH jump system differs from the previous examples by addition of borate and sorbitol, and a typical example of such a system is given by the following composition:

| Base Composition | | |
|---|---|---|
| Component | Composition A wt. % | Composition B wt. % |
| LAS - Acid | 22.7 | 22.7 |
| Neodol 25-9 | 10.4 | 10.4 |
| Sorbitol 70% | 4.3 | 21.0 |
| Na-citrate $2H_2O$ | 10.0 | 6.0 |
| NaOH 50% Solution | 5.7 | 5.7 |
| NaBorate 10H20 | 1.0 | 5.0 |
| Narlex DC-1 (33 wt % solution) | 4.5 | 4.5 |
| Water | to 100 | to 100 |
| Sokalan CP 5 (25 wt % solution) | 6.0 | 6.0 |
| EDTA* | 0.9 | 0.9 |
| Tinopal CBS-X** | 0.2 | 0.2 |

*Ethylene diamine tetraactic acid - Sequestrant
**Tinopal CBS-X - Fluorescer

The following results were obtained.

| Composition | Sisko Index "n" | Pour Viscosity mPas $21s^{-1}$ | % BLS (v/v) 30 days @ 37° C. |
|---|---|---|---|
| A | 0.18 | 657 | 1.1 |
| B | 0.30 | 649 | 1.2 |

This example shows that Sokalan CP5 renders the pH-jump formulation shear thinning in the range of Sorbitol of 3.0 to 14.7 wt. % and Borax of 1 to 5 wt. %.

Example 11

The following composition was prepared as follows:

Structuring polymer (aqueous solution of PAA 60.000 Daltons) was post added to the pH jump formulation containing peracid bleach (TPCAP, N,N'-tetraphthaloyl-di(6-aminocaproic peracid)).

| Composition | Parts |
|---|---|
| LAS - Acid | 22.7 |
| Neodol 25-9 | 10.4 |
| | Total surfactants 33.1 |
| 50% NaOH | 5.7 |
| Na-citrate $2H_2O$ | 8.2 |
| Borax | 3.2 |
| Sorbitol (70% solution) | 13.7 |
| Narlex DC-1 (33 wt. % solution) | 4.5 |
| Fluorescer | 0.2 |
| EDTA | 0.9 |
| Perfume | 0.25 |
| DI $H_2O$ (deionized water) | 16.9 |
| TPCAP (30% wet cake) | 11.4 (post-added)* |
| PAA (35% solution) | 2.0 (post-added)* |

*For formulation without PAA, 2.0 parts deionized water (DI) was added after TPCAP addition to make all formulations equal on a detergent surfactant basis.

The following results were obtained.

| Formulation | Sisko Index | Pour Voscosity (mPas) | % BLS (v/v) 30 days @ 37° C. |
|---|---|---|---|
| Base with no TPCAP & PAA | 0.50 | 525 | 0.0 |
| Base with TPCAP & no PAA | 0.43 | 816 | 0.0 |
| Base with TPCAP & PAA | 0.29 | 1490 | 0.0 |

This example shows that the structuring polymer produces the desired shear thinning effect in pH jump formulations containing peracid bleach particles.

Example 12

The following composition was prepared as follows:

Structuring polymer (aqueous solution of Sokalan CP-5) was post-added to the pH jump formulation containing peracid bleach (TPCAP, N,N'-tetraphthaloyl-di(6-aminocaproic peracid).

| Composition | Parts |
|---|---|
| LAS Acid | 22.7 |
| Neodol 25-9 | 10.4 |
| | Total surfactants 33.1 |
| 50% NaOH | 5.7 |
| Na-citrate $2H_2O$ | 8.2 |
| Borax | 3.2 |
| Sorbitol (70% solution) | 13.7 |
| Narlex DC-1 (33 wt. % solution) | 4.5 |
| Fluorescer | 0.2 |
| EDTA | 0.9 |
| Perfume | 0.25 |
| TPCAP (30% wt cake) | 8.0 or 16.0 |
| Sokalan CP-5 (25% solution) | 6.0 |
| DI $H_2O$ | Balance to 100.0 |

*For formulation without PAA, 2.0 parts deionized water (DI) was added after TPCAP addition to make all formulations equal on a detergent surfactant basis.

The following results were obtained.

| TPCAP level wt. % | Sisko Index "n" | Pour Viscosity mPas $21s^{-1}$ | % BLS (v/v) 30 days @ 37° C. |
|---|---|---|---|
| 1.8 | 0.31 | 425 | 3.2 |
| 4.8 | 0.29 | 1,757 | 0.0 |

This example shows that the level of TPCAP does not have any significant impact on the Sisko Index.

We claim:

1. A liquid detergent composition comprising (a) 31% to about 80% by wt. of one or more surfactants predominantly present as lamellar drops dispersed in an aqueous medium containing at least 1% by wt. electrolyte;

wherein said surfactant is selected from the group consisting of anionic surfactants, nonionic surfactants, cationic surfactants, amphoteric surfactants, zwitterionic surfactants and mixtures thereof; and wherein unsaturated fatty acids and salts thereof comprise no more than 2% by weight of the total composition;

(b) 0.1% to 20% by wt. deflocculating polymer;

(c) a substantially linear, water soluble, highly salt-tolerant, non-adsorbing, structuring ionic polymer having a molecular weight (MW) of 10,000 to 1,000,000 Daltons, the concentration of said structuring polymer ranging from a minimum of $a(MW)^{-0.75}$ wt. % to a maximum of 20% by weight, wherein a is equal to 770; and wherein the composition has a Sisko index of 0.35 or less as measured by the Sisko rheological model;

wherein said structuring polymer does not decrease the viscosity of the composition, as measured at 21 $sec^{-1}$, relative to the viscosity prior to addition of said polymer;

wherein said structuring polymer does not increase the viscosity, as measured at 21 $sec^{-1}$, above 5000 mpas; and wherein said composition results in no more than 5% bottom clear layer separation by volume upon storage at 37° C. for 30 days.

2. A composition according to claim 1, wherein the amount of electrolyte is 1% to 60% by wt. of the composition.

3. A composition according to claim 2, wherein the amount of electrolyte is 7% to 60% by wt. of the composition.

4. A composition according to claim 3, wherein the amount of electrolyte is 15% to 60% by wt. of the composition.

5. A composition according to claim 1, wherein the deflocculating polymer is 0.5 to 5% by wt. of the composition.

6. A composition according to claim 5, wherein the deflocculating polymer is 1.0 to 3% by wt. of the composition.

7. A composition according to claim 1, which additionally contains about 0.5 to 10% bleach particles.

8. A composition according to claim 7, wherein said particles comprise 1 to 5% by wt of the composition.

9. A composition according to claim 7, wherein the bleach particles are particles of N,N'-tetraphthaloyl-di-(6-aminocaproic peracid) (TPCAP).

10. A composition according to claim 1, wherein the surfactant is selected from the group consisting of alcohol ethoxylates, alkyl sulfates, alkyl ether sulfates, alkyl ether sulfonates, alkyl benzene sulphonates, acyl isethionates, saturated fatty acids, alkyl polyglycosides and aldobionamides.

11. A composition according to claim 1, wherein the structuring polymer is selected from the group consisting of polyacrylates, acrylate maleate copolymers, polystyrene sulfonate and dextran sulfate.

12. A composition according to claim 1, wherein the MW of the structuring polymer is 12,000 to 500,000 Daltons.

13. A composition according to claim 1, wherein the upper range concentration of the structuring polymer is 3% by wt. of the composition.

14. A composition according to claim 1, wherein the Sisko Index is 0.30 or less.

15. A liquid detergent pH jump system composition comprising (a) 31% to about 80% by wt. of one or more surfactants predominantly present as lamellar drops dispersed in an aqueous medium containing 1% to 60% by wt. electrolyte;

wherein said surfactant is selected from the group consisting of anionic surfactants, nonionic surfactants, cationic surfactants, amphoteric surfactants, zwitterionic surfactants and mixtures thereof; and wherein unsaturated fatty acids and salts thereof comprise no more than 2% by weight of the total composition;

(b) a pH jump system comprising 1.0% to 25.0% by wt., based on the weight of the composition, sorbitol; and 0.5% to 10.0% by wt., based on the weight of the composition, boron containing compound (c) 0.1% to 15% by wt. deflocculating polymer;

(d) 0.1 to 20% by wt. of a substantially linear water soluble, highly salt-tolerant, non-adsorbing structuring ionic polymer having a MW of 10,000 to 1,000,000 Daltons, the concentration of said structuring polymer ranging from a minimum of $a(MW)^{-0.75}$ wt. % to a maximum of 20% by weight, wherein a is equal to 770;

wherein the composition has a Sisko index of about 0.35 or less as measured by the Sisko rheological model;

wherein said structuring polymer does not decrease the viscosity of the composition, as measured at 21 $sec^{-1}$, relative to the viscosity prior to addition of said polymer;

wherein said polymer does not increase the viscosity, as measured at 21 $sec^{-1}$ above 5000 mPas; and where said composition results in no more than 5% bottom clear layer separation by volume upon storage at 37° C. for 30 days.

16. A composition according to claim 15, wherein the surfactant is selected from the group consisting of alcohol ethoxylates, alkyl sulfates, alkyl ether sulfates, alkyl ether sulfonates, alkyl benzene sulphonates, acyl isethionates, saturated fatty acids, alkyl polyglycosides and aldobionamides.

17. A composition according to claim 15, wherein sorbitol comprises 3.0 to 15.0 by wt. of the composition.

18. A composition according to claim 15, wherein boron containing compound comprises 1 to 5% by wt. of the composition.

* * * * *